US005519924A

United States Patent [19]

Fujita

[11] Patent Number: 5,519,924

[45] Date of Patent: May 28, 1996

[54] HEATING APPARATUS FOR FALSE TWISTING OF SYNTHETIC FIBER

[75] Inventor: Atsuhisa Fujita, Tokyo, Japan

[73] Assignee: Toyo Electric Co., Ltd., Japan

[21] Appl. No.: 163,791

[22] Filed: Dec. 7, 1993

[30] Foreign Application Priority Data

Dec. 8, 1992 [JP] Japan ..... 4-327875

[51] Int. Cl.[6] ..... D02G 1/00

[52] U.S. Cl. ..... 28/240; 28/241; 28/249; 219/388; 165/905

[58] Field of Search ..... 28/240, 241, 243, 28/246, 247, 249, 285; 34/627, 628, 618, 273; 219/388, 439, 462; 392/343, 346; 128/203.26, 203.27, 201.13; 126/221, 400; 165/185, 905

[56] References Cited

U.S. PATENT DOCUMENTS

| | | | |
|---|---|---|---|
| 3,015,872 | 1/1962 | Jones | 34/273 X |
| 3,061,940 | 11/1962 | Cichelli | 165/905 X |
| 3,061,941 | 11/1962 | Goy et al. | 28/241 X |
| 3,276,095 | 10/1966 | Killoran et al. | 28/241 |
| 3,401,682 | 9/1968 | Jakob | 126/400 |
| 4,025,753 | 5/1977 | Bennet | 219/388 |
| 4,122,588 | 10/1978 | Borenstein et al. | 28/241 X |
| 4,482,801 | 11/1984 | Habata et al. | 165/185 X |
| 4,584,464 | 4/1986 | Myer | 219/388 X |
| 4,820,905 | 4/1989 | Iwata et al. | 219/388 X |
| 4,858,590 | 8/1989 | Bailey | 219/462 X |
| 5,136,860 | 8/1992 | Graf | 219/388 X |
| 5,145,001 | 9/1992 | Valenzuela | 165/185 X |

FOREIGN PATENT DOCUMENTS

| | | | |
|---|---|---|---|
| 903968 | 7/1972 | Canada | 28/246 |
| 2738451 | 3/1979 | Germany | 28/240 |

*Primary Examiner*—John J. Calvert
*Attorney, Agent, or Firm*—Klima & Hopkins

[57] ABSTRACT

A non-contact type high-temperature heating apparatus for false twisting of synthetic fiber to provide increased efficiency and energy savings. The apparatus includes a main body defined by a metal tube, and end walls connected to the main body. The main body includes one or more grooves and/or passageways through which filaments pass along the length of the main body. Further, a heat-conductive powder and heating member are contained in the main body.

8 Claims, 6 Drawing Sheets

HEATING APPARATUS FOR FALSE TWISTING OF SYNTHETIC FIBER

BACKGROUND OF THE INVENTION

1. Field of the Invention

The present invention relates to a heating apparatus for false twisting of synthetic fiber which is used for false twisting a filament of thermoplastic synthetic fiber such as polyester or polyamide.

2. Description of Related Art

Conventional heat treatment apparatuses for false twisting of a filament of thermoplastic synthetic fiber are usually divided into contact type heating apparatuses and non-contact type high-temperature heating apparatuses.

Most contact type heating apparatuses employ a heating method which uses saturated vapor as the heat medium. Recently, high-speed processing and energy savings have been demanded in order to improve processing efficiency. However, the following problems prevent such demands from being satisfied.

To achieve high-speed processing, an enlarged heater is needed so that the resistance which a running filament encounters increases. The height of a false twister is enlarged so that a tall building is required to accommodate the apparatus, and thus maintenance is difficult to perform. As regards energy saving, stains on the surface in which a filament contacts increase thereby requiring procedures for cleaning. Thus, energy savings are difficult to achieve. Additionally, the availability of the apparatus is reduced because it is necessary to cease its operation for cleaning.

The non-contact type high-temperature heating apparatus is preferable for achieving false twisting capable of high-speed processing and saving energy. In such an apparatus, a groove-like passage through which a filament passes is formed by cutting the outside face of a long, heat-conductive, bar shaped material, such as a brass alloy (so-called brass), and a heating member is provided within the passage. By feeding a filament through the above mentioned passage, the filament is heated at a high temperature and a false twist of the filament is fixed.

However, the above non-contact type high-temperature heating apparatus has the following problems. One of the problems is that it is difficult to form a long groove and a heating member accommodating section axially on a bar-shaped metal such as a long brass alloy by cutting. As to the type of metal employed, if a heat resisting alloy, for example, inconel or a brass alloy, is used, it is further difficult to process the long groove and the heating member accommodating section because of the high degree of hardness, thereby leading to an increase in the manufacturing cost.

SUMMARY OF THE INVENTION

Accordingly, it is an object of the present invention to provide a non-contact type high-temperature heating apparatus, and more particularly to provide a heating apparatus for false twisting of synthetic fiber, the filament running section and the heating member accommodating section of which can be easily produced.

To achieve the foregoing and other objects of the present invention, there is provided a heating apparatus for false twisting of synthetic fiber comprising a main body of the heating apparatus which is formed of metal having a tubular shape, both ends of which have respective end walls; a passage which is formed along the length of the main body and through which a filament is fed; heat-conductive powder or grain which is contained in the main body; and a heating member which is provided in the main body.

According to another aspect of the present invention, there is provided a heating apparatus for false twisting of synthetic fiber in which the passages for the filament are constructed in the form of groove on the outside of the main body.

According to still another aspect of the present invention, there is provided a heating apparatus for false twisting of synthetic fiber in which the groove-like passages have guides.

According to a further aspect of the present invention, there is provided a heating apparatus for false twisting of synthetic fiber including tubular passages which run through both ends and are located inside and outside of the main body.

According to a still further aspect of the present invention, there is provided a heating apparatus for false twisting of synthetic fiber in which passages are constructed in the form of a groove outside of said main body, and further, formed inside of said main body so as to run through both end walls so that either passage can be selectively used for actual operation.

According to a yet still further aspect of the present invention, there is provided a heating apparatus for false twisting of synthetic fiber comprising a main body of said heating apparatus which is formed of metal having a tubular shape and is bent relative to the length of the main body, both ends of which having respective end walls; a passage, which is constructed in the form of a groove, located outside of the main body and having a guide to direct a filament; heat-conductive powder or grain which is contained in the main body; and a heating member which is provided in the main body.

According to a yet still further aspect of the present invention, there is provided a heating apparatus for false twisting of synthetic fiber in which the powder or grain is metallic.

According to a yet still further aspect of the present invention, there is provided a heating apparatus for false twisting of synthetic fiber in which the powder or the grain is carbon.

According to a yet still further aspect of the present invention, there is provided a heating apparatus for false twisting of synthetic fiber in which the powder or the grain is a metallic compound.

According to a yet still further aspect of the present invention, there is provided a heating apparatus for false twisting of synthetic fiber in which the main body has air ventilating holes.

According to a yet still further aspect of the present invention, there is provided a heating apparatus for false twisting of synthetic fiber in which a heat insulating material is provided outside of the main body to heat-insulate the main body from outside.

According to the structure of the present invention described above, the main body is produced by extrusion and heat-conductive powder or grain and a heating member are incorporated inside of the main body. In the prior art, on the other hand, a long metal bar must be formed by cutting or the like as described in the Related Art. Thus, the present invention can very easily perform such a troublesome process in the prior art. Additionally, it is not necessary to provide a heating member supporting section by cutting, but the heating member may be easily supported in the main body by welding and can be divided into stages in the main body. A lead wire and the like can be easily introduced outside of the main body making it possible to partially control the temperature. In the case where a guide is provided in the passage where the filament passes and in the case where the passage is bent relative to the length of the main body and the guide is provided, it is possible to prevent the filament from moving side to side while it is being fed and making contact with the surface of the main body causing it melt. If a ventilating hole is provided on the main body, it is possible to discharge air expanded due to heat generated inside of the main body in order to adjust the internal pressure, thereby allowing an action to be performed preferably in the main body.

DESCRIPTION OF THE PREFERRED EMBODIMENT

Figure 1:
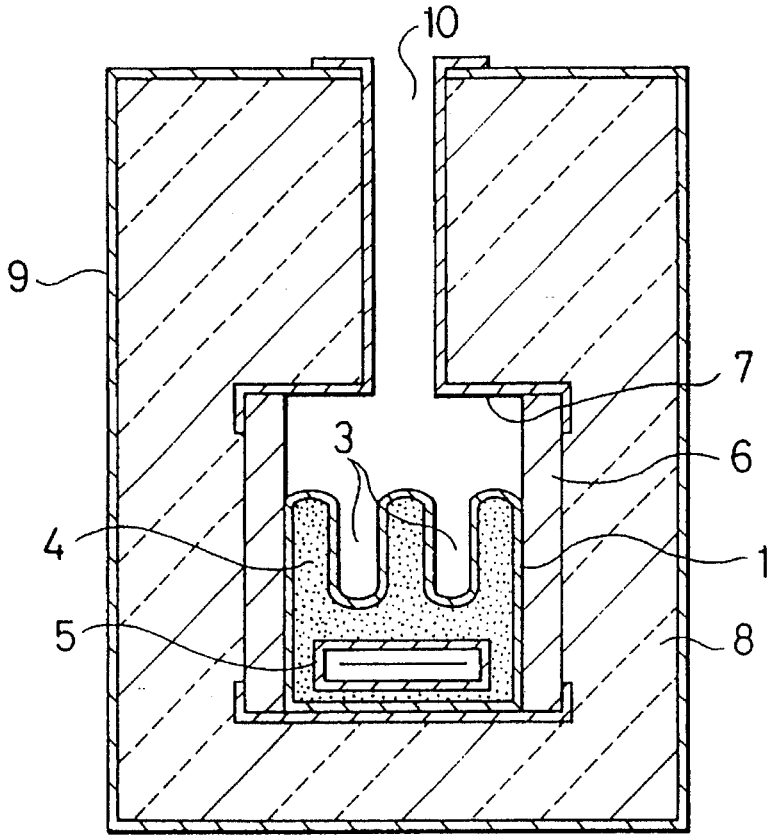
FIG. 1 is a sectional side view of a heating apparatus for false twisting of synthetic fiber which is an embodiment of the present invention and which is provided with a heat insulating material on the outside of the heating apparatus.
Figure 2:
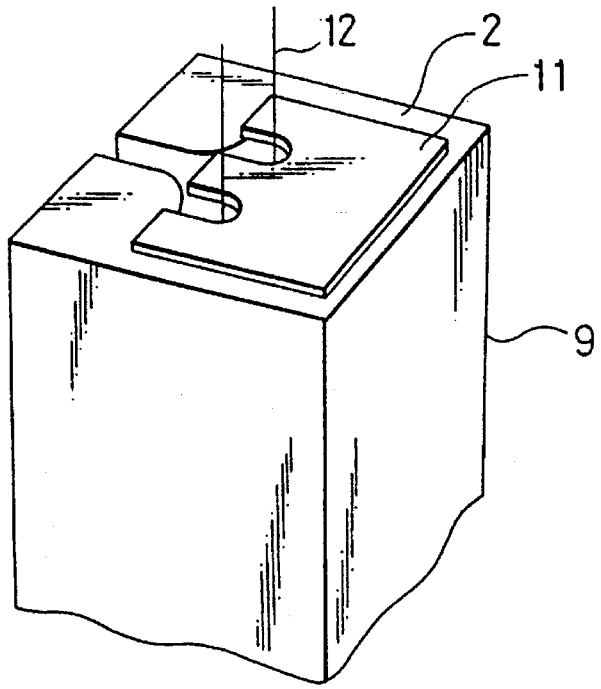
FIG. 2 is a perspective view of the top end of the heating apparatus shown in FIG. 1.
Figure 3:
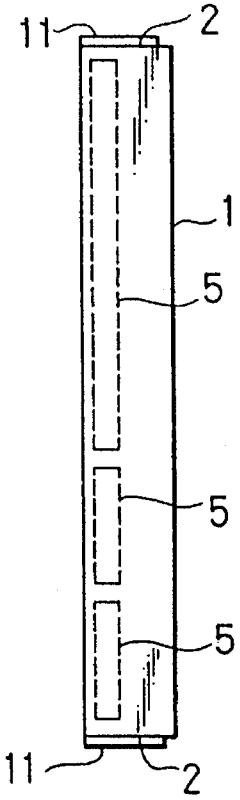
FIG. 3 is a side view of the heating apparatus for false twisting showing an embodiment of the present invention.
Figure 6:
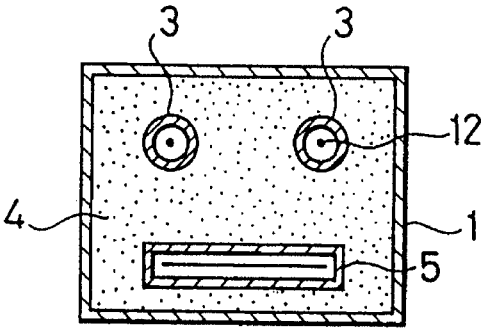
FIG. 6 is a sectional side view of the heating apparatus which is a fourth embodiment of the present invention.

FIGS. 1–3 show an apparatus according to an embodiment of the present invention. Numeral 1 indicates the main body of a heating apparatus, which is, for example, a tubular stainless material formed by extrusion. As shown in FIG. 3, end walls 2 are formed on both ends along the length of the main body 1. The main body 1 may be made of any metal if the metal is heat resistant. The main body 1 may be made of a heat resisting metal having a high hardness, such as inconel. Numeral 3 indicates a passage through which a filament passes. The passage may be constructed in the form of a groove, as shown in FIG. 1, or in the form of a tube in the main body 1, as shown in FIG. 6. The passage 3 may be constructed outside or inside of the main body 1. Numeral 4 indicates heat-conductive powder or grain, which is, for example, powdered brass alloy or so-called brass powder. The heat-conductive powder or grain 4 may be made from stainless or carbon powder, or a mixture of these materials. It is permissible to use magnesium oxide or zinc oxide. Any kind of metal may be used so long as it is heat-conductive.

Figure 4:
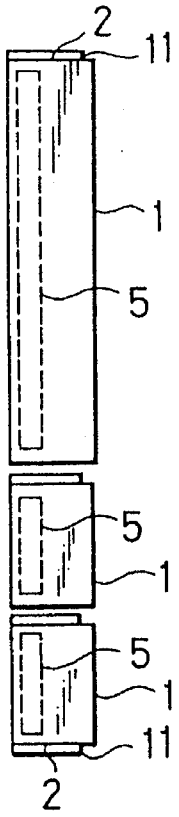
FIG. 4 is a side view corresponding to FIG. 3 which illustrates a second embodiment of the present invention.
Figure 5:
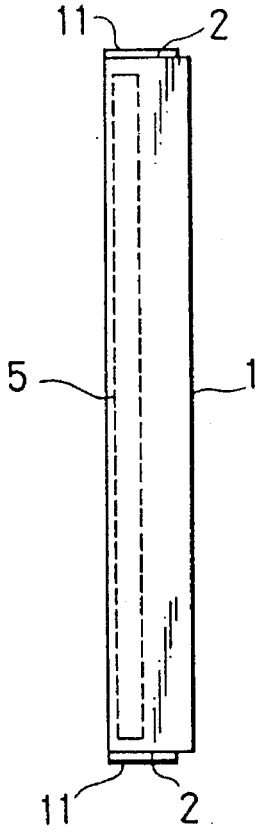
FIG. 5 is a side view corresponding to FIG. 3 which illustrates a third embodiment of the present invention.

Numeral 5 indicates a heating member, which is, for example, a sheathed heater. As shown in FIG. 1, the heating member 5 is provided in the main body 1 so that it is in contact with the heat-conductive powder or grain 4. Referring to FIG. 1, numeral 6 indicates a formed heat insulating material, numeral 7 indicates a reflecting plate, numeral 8 indicates a heat insulating material, numeral 9 indicates a casing, and numeral 10 indicates a communicating path. Referring to FIGS. 2, 3 and 4, numeral 11 indicates a guide for a filament, which is made of, for example, ceramic. Numeral 12 indicates a filament. An apparatus which applies false twists to the filament is provided back and forth of the main body 1 along a filament feeding path. However, a description of this apparatus is omitted because the apparatus is not a subject of the present invention.

As shown in FIGS. 3 and 4, it is preferable to provide a plurality of the heating members. This is because this construction enables easy control of the temperatures of each portion throughout the entire apparatus. FIG. 3 shows the case where the heating member 5 is divided in the main body 1. FIG. 4 shows the case where respective heating members 5 are provided in divided sections of the main body 1.

Although a representation of supporting portions for the heating members is omitted, the supporting portions may be provided easily by welding. This procedure is far easier than a case where a heating means is provided in a metal bar which is processed by cutting and the like.

Figure 7:
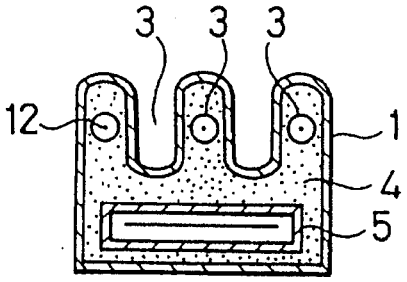
FIG. 7 is a sectional side view corresponding to FIG. 6 which illustrates a fifth embodiment of the present invention.
Figure 8:
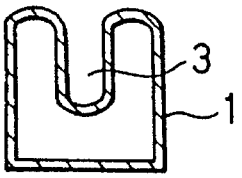
FIG. 8 is a sectional side view of a part of the heating apparatus which is a sixth embodiment of the present invention.
Figure 9:
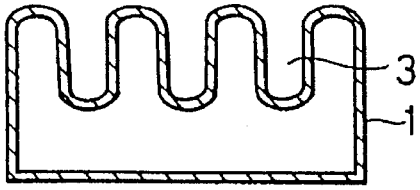
FIG. 9 is a sectional side view corresponding to FIG. 8 which illustrates a seventh embodiment of the present invention.
Figure 10:
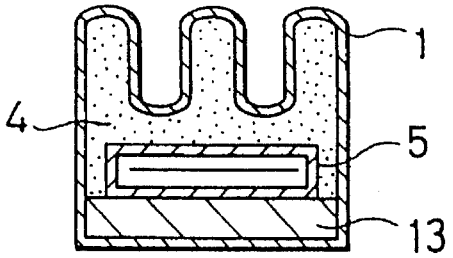
FIG. 10 is a sectional side view corresponding to FIG. 6 which illustrates an eighth embodiment of the present invention.
Figure 11:
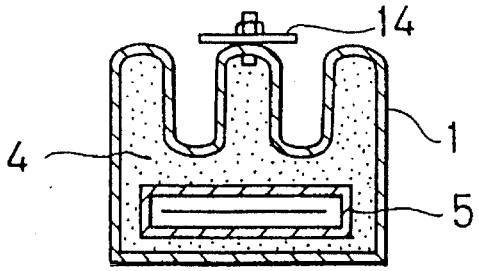
FIG. 11 is a sectional side view corresponding to FIG. 6 which illustrates a ninth embodiment of the present invention.

A lead wire of the heating member 5 can be easily introduced outside of the main body 1 because the main body 1 is formed by extrusion as described above. It is permissible to form inside of the main body 1, tubular passages 3 through which the filaments passes, as shown in FIGS. 6 and 7, or form the tabular passages inside of the main body 1 and at the same time, provide the passages outside of the main body 1 as shown in FIG. 7. This structure allows selection of any one of the inside tubular passages or the outside passages. Additionally, it is possible to select whether a single groove like passage is provided, as shown in FIG. 8, or a plurality of the groove like passages are provided, as shown in FIG. 9. It is permissible to provide the heat insulating material 13 in the back of the heating member 5 because it is desirable that the temperature at the back of the main body 1 be low. As shown in FIG. 11, it is permissible to fix the reflecting plate 14 onto the main body 1.

Figure 12:
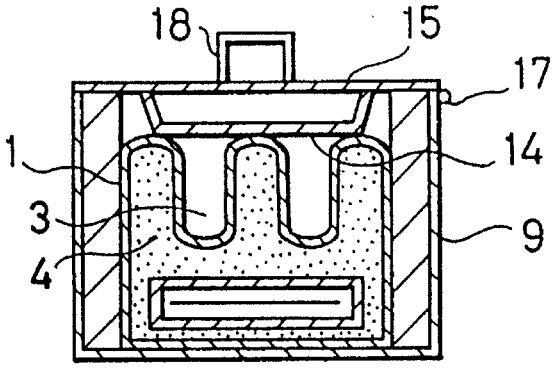
FIG. 12 is a sectional side view corresponding to FIG. 1 which illustrates a tenth embodiment of the present invention.
Figure 13:
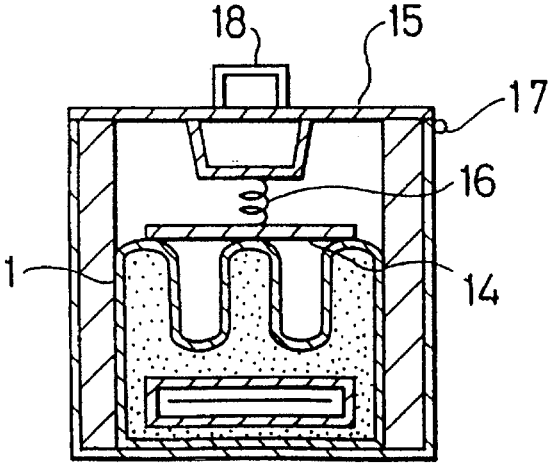
FIG. 13 is a sectional side view corresponding to FIG. 1 which illustrates an eleventh embodiment of the present invention.
Figure 14:
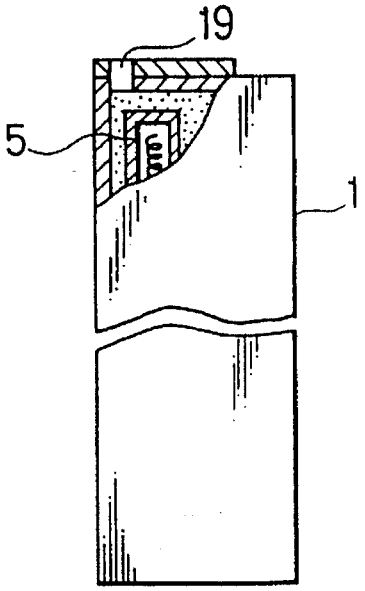
FIG. 14 is a side view of the heating apparatus which illustrates a twelfth embodiment of the present invention.

FIGS. 12 and 13 show the cases where a door 15 which opens or closes the passage 3 in the main body 1 is provided on a casing 9 which contains the main body 1. Numeral 14 indicates the reflecting plate, numeral 16 indicates a spring, numeral 17 indicates a hinge and numeral 18 indicates a handle. As shown in FIG. 14, a hole 19 is formed on the main body 1. This hole communicates air expanded because the inside of the main body 1 is heated by the heating member 5 with outside air, thereby allowing the filament 12 to be heated preferably.

Figure 15:
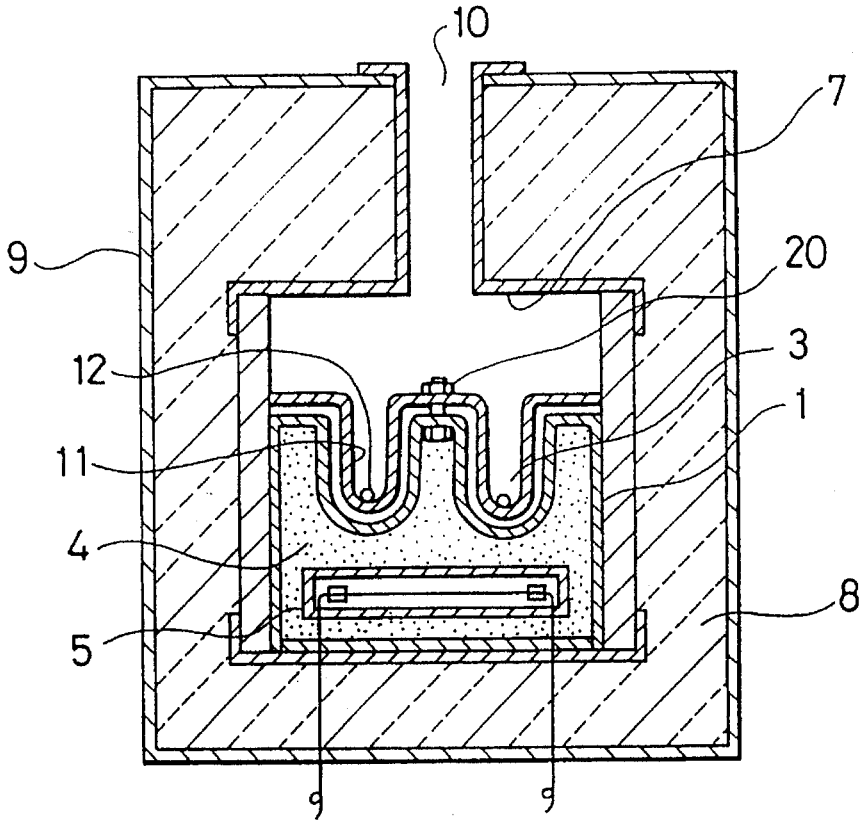
FIG. 15 is a sectional side view of the heating apparatus corresponding to FIG. 1 which illustrates a thirteenth embodiment of the present invention.
Figure 16:
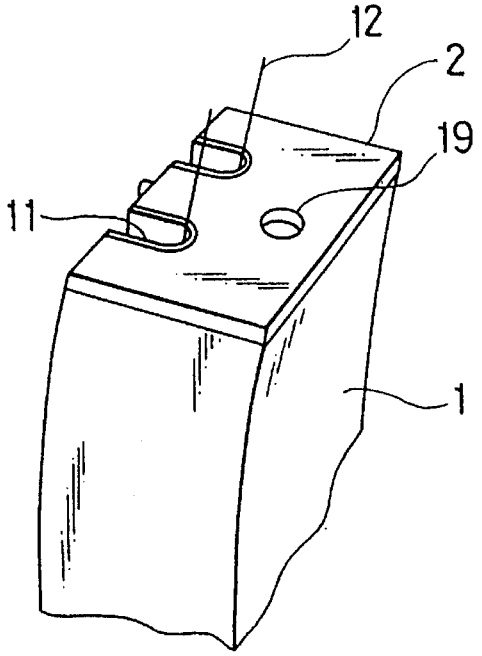
FIG. 16 is a perspective view of the top end of the heating apparatus shown in FIG. 15.
Figure 17:
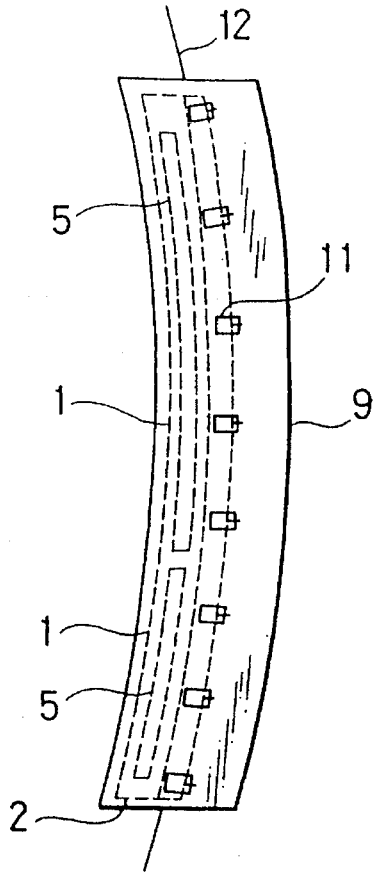
FIG. 17 is a side view of the heating apparatus shown in FIG. 15.
Figure 18:
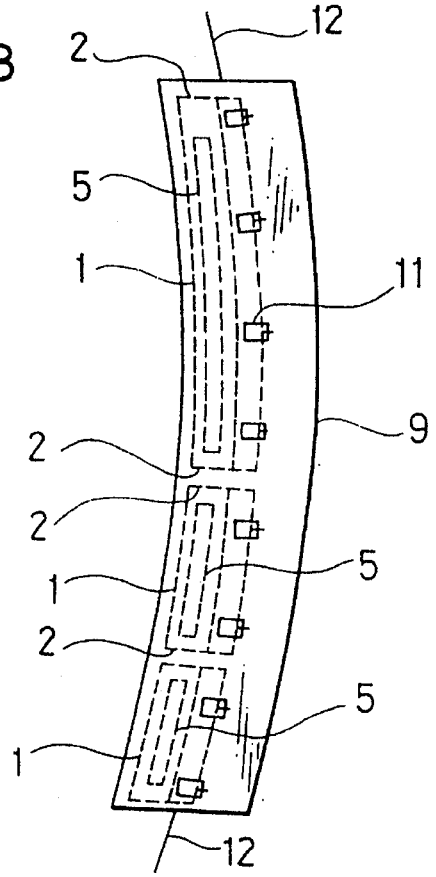
FIG. 18 is a side view corresponding to FIG. 17 which illustrates a fourteenth embodiment of the present invention.
Figure 19:
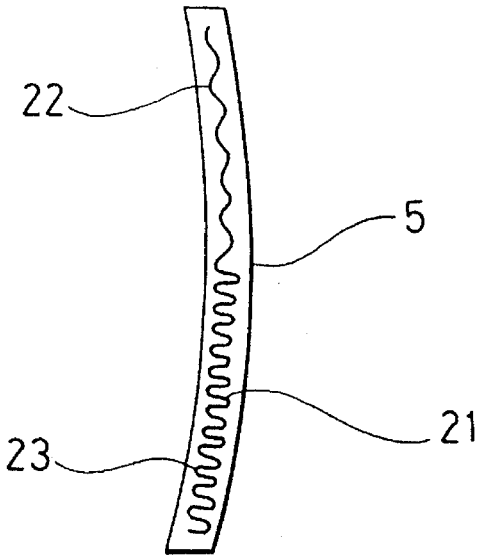
FIG. 19 is a diagram outlining a part of the present invention which illustrates a fifteenth embodiment of the present invention.
Figure 20:
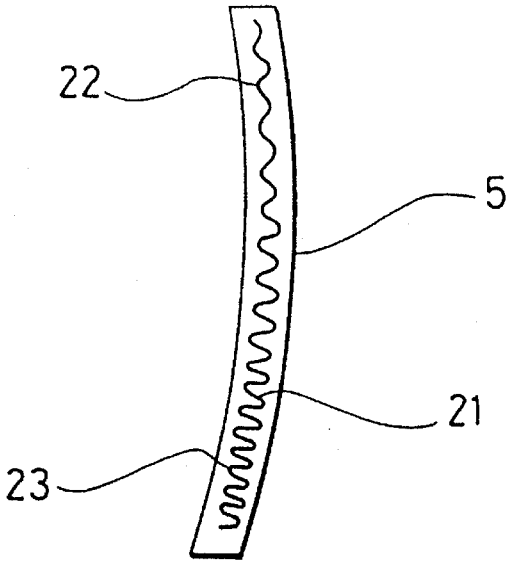
FIG. 20 is a diagram corresponding to FIG. 19 which illustrates a sixteenth embodiment of the present invention.

Referring to FIGS. 15–18, the main body 1 is bent relative to its length, thus being different from a straight body as shown in FIGS. 3, 4 and the like. Numeral 11 indicates a guide. The guide is formed of, for example, ceramics so that the cross section is as shown in FIG. 15 and a plurality of the guides are provided at the same interval in the main body 1. Numeral 20 is a fixing member which is provided on the main body 1. For example, a bolt and a nut are used for this member. Because the main body 1 is bent relative to the length of the main body, as shown in FIG. 16, the filament can be prevented from moving side to side while it is being fed. In the main body 1 which is bent as described above, it is possible to form each of the respective structures shown in FIGS. 3, 4, 5, 8, 9, 10, 11, 12 and 13. The sectional views of these constructions are omitted because they are almost the same as the sectional views shown in FIGS. 3, 4, 5, 8, 9, 11, 12 and 13. The heating member 5 may be formed as shown in FIGS. 19 and 20. Referring to FIGS. 19 and 20, numeral 21 indicates a nichrome wire. For example, as shown in FIG. 19, the nichrome wire is formed subtly at the top area and it is formed densely at the bottom area 23. Thus, the temperature of the bottom area is higher than that of the top area 22. Generally, however, in this type of apparatus, the higher the position, the higher is the temperature. Thus, the aforementioned structure enables the entire area to be heated at almost the same temperature. Although the nichrome wire in the case shown in FIG. 19 is divided into two stages, the nichrome wire may be divided into three stages. In contrast to the wire shown in FIG. 19, the nichrome wire shown in FIG. 20 is formed so that it is formed continuously without stages.

According to the structure of the present invention as described above, the main body is produced by extrusion and heat-conductive powder or grain and the heating member 5 are incorporated inside of the main body. In the prior art, on the other hand, a long metal bar must be formed by cutting or the like as described in Description of the Prior Art. Thus, the present invention can very easily perform such a troublesome process in the prior art. Additionally, it is not necessary to provide a heating member supporting section by cutting, but the heating member 5 may be easily supported in the main body by welding and can be divided into stages in the main body 1. The lead wire and the like can be easily introduced outside of the main body 1 facilitating partial control of the temperature. In the case where the guide 11 is provided in the passage 3 where the filament passes and in the case where the passage 3 is bent relative to the length of the main body, it is possible to prevent the filament 12 from moving side to side while it is being fed and making contact with the surface of the main body 1 causing it to melt. Because the ventilating hole 19 is provided on the main body 1, it is possible to discharge air expanded due to heat generated inside of the main body 1 in order to adjust the internal pressure, thereby maintaining phenomenon caused in the main body 1 in good condition. Additionally, because the heat insulating material 8 is provided outside of the main body 1, it is possible to prevent heat in the main body 1 from escaping, thereby contributing to effective false twisting.

What is claimed is:

1. A heating apparatus for false twisting of synthetic fiber, comprising:

a main body made of metal and formed in a tubular shape, said main body having respective end walls, said main body including at least one filament run formed along the length of said main body;

a heating member provided in said main body; and metal heat-conductive powder contained in said main body and located between said heating member and said at least one filament run.

2. A heating apparatus for false twisting of synthetic fiber according to claim 1, wherein said at least one filament run is defined by at least one groove provided on an outside surface of said main body.

3. A heating apparatus for false twisting of synthetic fiber according to claim 2, wherein said at least one groove includes a filament guide.

4. A heating apparatus for false twisting of synthetic fiber according to claim 1, wherein said at least one filament run is defined by at least one tubular passageway extending through said main body and ends walls.

5. A heating apparatus for false twisting of synthetic fiber according to claim 1, wherein said at least one filament run is defined by at least one groove provided in an outer surface of said main body and through holes through said end plates located at opposite ends of said at least one groove, and at least one passageway extending through said main body and said end plates.

6. A heating apparatus for false twisting of synthetic fiber according to claim 1, wherein said main body is curved along a length of said main body, and said at least one filament run includes a guide.

7. A heating apparatus for false twisting of synthetic fiber according to claim 1, including an enclosure of a heat insulating material provided outside of said main body to heat-insulate said main body from the outside environment.

8. A heating apparatus for false twisting of synthetic fiber according to claim 1, wherein said heating member extends along a length of said tubular main body, and said metal heat-conductive powder surrounds said heating member separating said heating member from a wall of said main body located adjacent said filament run.

* * * * *